US007451800B2

(12) United States Patent
Johnson et al.

(10) Patent No.: US 7,451,800 B2
(45) Date of Patent: Nov. 18, 2008

(54) APPARATUS AND SYSTEM FOR AN EXPANDABLE, HINGED, MULTI-PANEL PRESENTATION

(75) Inventors: Benjamin Patrick Johnson, San Carlos, CA (US); Khiet Quang Nguyen, San Jose, CA (US); Jack Chiu-Chiu Yuan, San Jose, CA (US)

(73) Assignee: International Business Machines Corporation, Armonk, NY (US)

( * ) Notice: Subject to any disclaimer, the term of this patent is extended or adjusted under 35 U.S.C. 154(b) by 14 days.

(21) Appl. No.: 11/567,622

(22) Filed: Dec. 6, 2006

(65) Prior Publication Data

US 2008/0134549 A1 Jun. 12, 2008

(51) Int. Cl.
*A47G 5/00* (2006.01)

(52) U.S. Cl. ..... 160/135; 10/124.12

(58) Field of Classification Search ..... 160/135, 160/230, 231.1, 231.2; 281/19.2, 27.1, 27.2, 281/3.1; 40/124, 124.09, 124.11, 124.12, 40/124.191, 534, 538, 605, 610; 434/430; 52/239

See application file for complete search history.

(56) References Cited

U.S. PATENT DOCUMENTS 3,638,967 A 2/1972 Mullins ..... 281/33
5,246,253 A * 9/1993 Mykrantz ..... 283/117
5,472,288 A 12/1995 Deutsch et al. ..... 402/4
5,720,464 A 2/1998 Meinscher et al. ..... 248/447
5,775,919 A * 7/1998 Gardner ..... 434/408
5,911,522 A * 6/1999 Wood ..... 40/124.09
5,960,848 A 10/1999 Schirer ..... 160/135
6,012,594 A 1/2000 Heinz ..... 211/46
6,113,298 A * 9/2000 Miro ..... 402/13

(Continued)

OTHER PUBLICATIONS

"Cardinal Horizontal Easel Ring Binder for 11×8½ sheets. 1" Rings" Cardinal, Item #CRD09260 and #CRD09261, http://www.shoplet.com/office/db/CRD09260.html.

"Marsh SE-351-Attachment with Rings for Flip Chart" Whiteboards & more, http://www.white-boards-and-more.com/Marsh-SE-351-MR1133.html.

"Presentation Binder 1½", 8½"×11" Capacity, Black " Bond Street, Item #BNDHT2019BLK, http://www.shoplet.com/office/db/BNDHT2019BLK.html.

*Primary Examiner*—Katherine Mitchell
*Assistant Examiner*—Jeremy C Ramsey
(74) *Attorney, Agent, or Firm*—Kunzler & McKenzie

(57) ABSTRACT

An apparatus and system for an expandable, hinged, multi-panel presentation. The apparatus includes a main rectangular panel, a side rectangular panel, a fastener, and an interior rectangular panel. The interior rectangular panel includes a proximal interior section having a width equal to the width of the side rectangular panel and a distal interior section coupled to the proximal interior section by a vertical hinge. The vertical hinge permits the distal interior section to pivot relative to the proximal interior section. In a first position, the interior rectangular panel displays presentation material on a front display face while overlaying the main rectangular panel and in a second position, the interior rectangular panel pivots and displays presentation material on a back display face while overlaying the side rectangular panel. Beneficially, the apparatus and system displays a greater amount of presentation material without increasing spatial area required for the display system.

4 Claims, 3 Drawing Sheets

U.S. PATENT DOCUMENTS

| | | | | |
|---|---|---|---|---|
| 6,155,325 | A | 12/2000 | Schirer | 160/135 |
| 6,382,433 | B1 | 5/2002 | Podergois | 211/195 |
| 7,004,507 | B2 | 2/2006 | Shulman | 283/106 |
| 7,040,899 | B2 * | 5/2006 | Armstrong | 434/430 |
| 2004/0148832 | A1 * | 8/2004 | Albenda | 40/610 |
| 2004/0231203 | A1 * | 11/2004 | Dobelbower et al. | 40/124.09 |
| 2006/0048421 | A1 | 3/2006 | Oleksak | 40/610 |
| 2007/0151132 | A1 * | 7/2007 | Repecki | 40/124.12 |

* cited by examiner

APPARATUS AND SYSTEM FOR AN EXPANDABLE, HINGED, MULTI-PANEL PRESENTATION

BACKGROUND OF THE INVENTION

1. Field of the Invention

This invention relates to the field of presentation systems and more particularly relates to portable presentation systems.

2. Description of the Related Art

Presentation systems are utilized for the display of educational information, product information, advertising, and artwork at a variety of venues such as science fairs, conferences, tradeshows, seminars, and other events. Commonly, portable presentation systems allow a user to arrange their display material in advance on the display device and one portable presentation system can be utilized at several events. Presentation systems are traditionally designed as a tri-panel apparatus consisting of a main panel and two side panels that pivot with respect to the main panel and allow the apparatus to be free-standing.

During events where presentation systems are customarily used, such as tradeshows and educational fairs, there is a limited amount of space available either on tables, the floor, or walls for each participant. Portable presentation systems can be designed to fit in the assigned space allotted by the event; however, the conventional tri-panel presentation system restricts the amount of display area that can be used for presentation material to the front surfaces of the main panel and each of the two smaller side panels. Using the conventional tri-panel presentation system, users quickly run out of display area when presenting large or complex demonstrations.

In an effort to overcome this disadvantage, other solutions have been suggested. One approach is to use a flip-chart presentation system, varieties of which are known in the art. Flip charts allow a user to display greater amounts of material by attaching multiple pages of display material to a support board while allowing the pages to pivot over the top of the apparatus and rest unseen on the back side of the support board. A further modification has been suggested in a tri-panel approach in which the center panel a of tri-panel presentation system incorporates a flip-chart apparatus allowing a user to have multiple display pages that can be flipped sequentially over the back of the display device.

While these systems allow a user to present more information, there are several disadvantages. One disadvantage inherent to any flip-chart presentation system is that it is cumbersome to flip pages over the back of the display device while presenting. Furthermore, because a user must be able flip the chart over the top of the device, the device is limited in terms of its height as well as the type of location in which it can be displayed. For example, a flip-chart presentation can not stand against a wall or other vertical barrier. If set on a table, the table height affects a user's ability to flip the pages over the top. Furthermore, in order to review previously-presented material, flip-chart pages are flipped back over the display device until the desired page is found. Additionally, the presentation material on flipped pages must be presented on pliable material such as poster paper. Certain presentation material may not work well with a pliable presentation surface.

Another solution has been presented as a flip-chart that rests on its side so that the pages flip horizontally around a vertical spine. While this presentation system does allow more presentation material to be displayed in a limited amount of space, this system does not easily accommodate the conventional tri-panel system in which the main panel is greater in width then the side panels. In this horizontal flip-chart system, the interior leaves of the flip-chart would be prevented from overlaying the main panel completely, or would be greater in width than the side panel and would, therefore, increase the size of the display system once the interior leaf was flipped to the side.

Therefore, a need exists for a portable presentation system that overcomes the disadvantages of the prior art. From the foregoing discussion, it should be apparent that a need exists for an apparatus that allows a user to professionally and easily display a greater amount of presentation material without increasing the amount of spatial area required for the display system.

SUMMARY OF THE INVENTION

The present invention has been developed in response to the present state of the art, and in particular, in response to the problems and needs in the art that have not yet been fully solved by currently available presentation systems. Accordingly, the present invention has been developed to provide an apparatus and system for expanding the display area of a presentation system while maintaining its outer dimensions and professional appearance that overcome many or all of the above-discussed shortcomings in the art.

The apparatus to display presentation material is provided with a main rectangular panel with a front display face, a side rectangular panel with a front display face and a width less than the width of the main rectangular panel, an interior rectangular panel with both a front and back display face, and a fastener. The fastener links the main rectangular panel and the side rectangular panel through holes disposed along the juxtaposed vertical edges of each panel at equal distances from their bottom horizontal edge. The fastener opens and closes allowing the removable attachment of interior rectangular panels and is designed to allow any rectangular panel to pivot relative to another panel. When the side rectangular panel pivots between the angles of 0 and 180 degrees, the side rectangular panel supports the apparatus such that the apparatus is free-standing.

The width of the interior rectangular panel is substantially the same width as the main rectangular panel and comprises a proximal interior section and a distal interior section. The interior rectangular panel includes a vertical hinge that permits the distal interior section to pivot about the vertical hinge and overlay the proximal interior section. In this manner, the folded interior panel becomes the same width as the side rectangular panel. The proximal interior section of the interior panel has a hole that allows the fastener to engage and couple it to the main and side rectangular panels such that the interior rectangular panel pivots to cover the main rectangular panel or the side rectangular panel.

The interior rectangular panel, in one embodiment, is configured to have presentation material on its front display face. The front display face is visible with the interior rectangular panel positioned in front of the main rectangular panel. Additional presentation material may be displayed in a two-step process: first, the vertical hinge permits the distal interior section to pivot relative to the proximal interior section and second, the fastener allows the folded interior rectangular panel to pivot and overlay the side rectangular panel. In this two-step process, new presentation material is displayed on the front display face of the main rectangular panel. Furthermore, in this embodiment, the interior rectangular panel can have presentation material on its back display face.

In a further embodiment, the apparatus to display presentation material may include a second fastener and a second side rectangular panel with a front display face and with a width less than the main rectangular panel. In this embodiment, the main rectangular panel is linked to both side rectangular panels, one on each vertical side of the main rectangular panel. Additionally in this embodiment, the distal interior section of the interior rectangular panel has a notch such that the notch engages the second fastener when the interior rectangular panel is positioned in front of the main rectangular panel.

A system to display presentation material is also provided with a main rectangular panel with a front display face, a right side rectangular panel with a front display face and a width less than the width of the main rectangular panel, a left side rectangular panel with a front display face and a width equal to the width of the right side rectangular panel, an interior rectangular panel with both a front and back display face, a first fastener, and a second fastener. The right side rectangular panel displays presentation material to the right of the main rectangular panel and the left side rectangular panel displays presentation material to the left side of the main rectangular panel. The first fastener links the main rectangular panel and the right side rectangular panel through holes disposed along the juxtaposed vertical edges of the main rectangular panel and the right side rectangular panel at equal distances from their bottom horizontal edge. The second fastener links the main rectangular panel and the left side rectangular panel through holes disposed along the juxtaposed vertical edges of the main rectangular panel and the left side rectangular panel at equal distances from their bottom horizontal edge.

The first and second fasteners open and close allowing the removable attachment of interior rectangular panels. The first fastener is designed to allow the right side rectangular panel to pivot relative to the main rectangular panel and allows an attached interior rectangular panel to pivot relative to the right side rectangular panel and the main rectangular panel. The second fastener is designed to allow the left side rectangular panel to pivot relative to the main rectangular panel and allows an attached interior rectangular panel to pivot relative to the left side rectangular panel and the main rectangular panel. When either the right side rectangular panel or the left side rectangular panel pivots between the angles of 0 and 180 degrees, the pivoted side rectangular panel supports the presentation system such that the presentation system is free-standing.

The width of the interior rectangular panel is substantially the same width as the main rectangular panel and comprises a proximal interior section and a distal interior section. The interior rectangular panel includes a vertical hinge that permits the distal interior section to pivot about the vertical hinge and overlay the proximal interior section. In this manner, the folded interior panel becomes the same width as the right side rectangular panel. The proximal interior section of the interior panel has a hole that allows either the first or second fastener to engage and couple it to the main rectangular panel and one of the right or left side rectangular panels such that the interior rectangular panel pivots to cover the main rectangular panel or one of the right or left side rectangular panels. The distal interior section of the interior rectangular panel has a notch that allows either the first or second fastener to engage the interior rectangular panel such that the interior rectangular panel lies flush with either the main rectangular panel or one of the right or left side rectangular panels.

The interior rectangular panel, in one embodiment, is configured to have presentation material on its front display face. The front display face is visible with the interior rectangular panel positioned in front of the main rectangular panel. Additional presentation material may be displayed in a two-step process: first, the vertical hinge permits the distal interior section to pivot relative to the proximal interior section and second, the first or second fastener allows the folded interior rectangular panel to pivot and overlay either the right or left side rectangular panel. In this two-step process, new presentation material is displayed on the front display face of the main rectangular panel. Furthermore, in this embodiment, the interior rectangular panel can have presentation material on its back display face.

In another embodiment, the system of the present invention comprises a main rectangular panel further provided with a back support configured to position a front surface of the main rectangular panel in a substantially vertical position.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
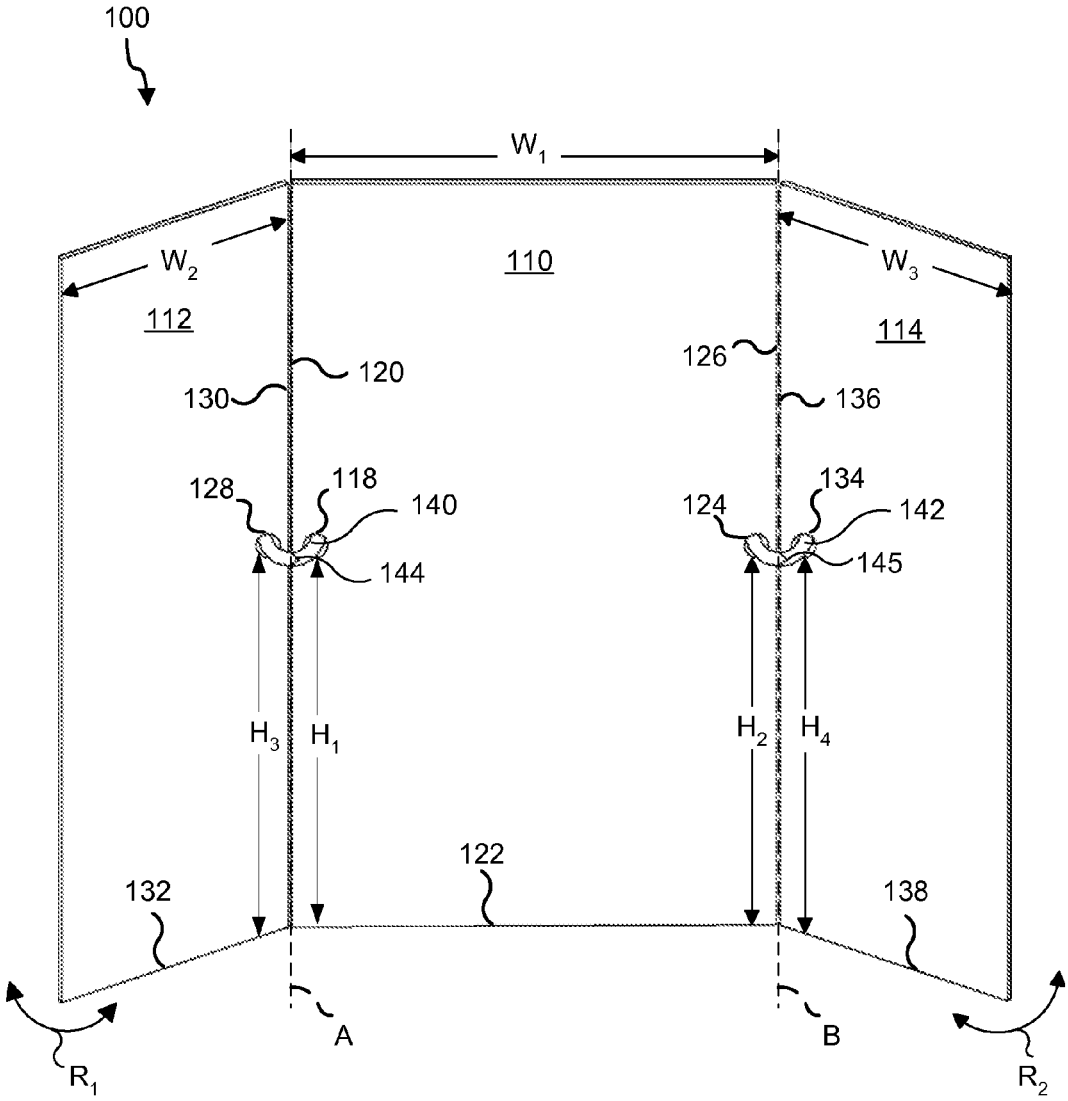
FIG. 1A is a front, perspective view of the expandable, hinged, multi-panel presentation apparatus illustrating one embodiment of the present invention having a main rectangular panel and two side rectangular panels.
Figure 1B:
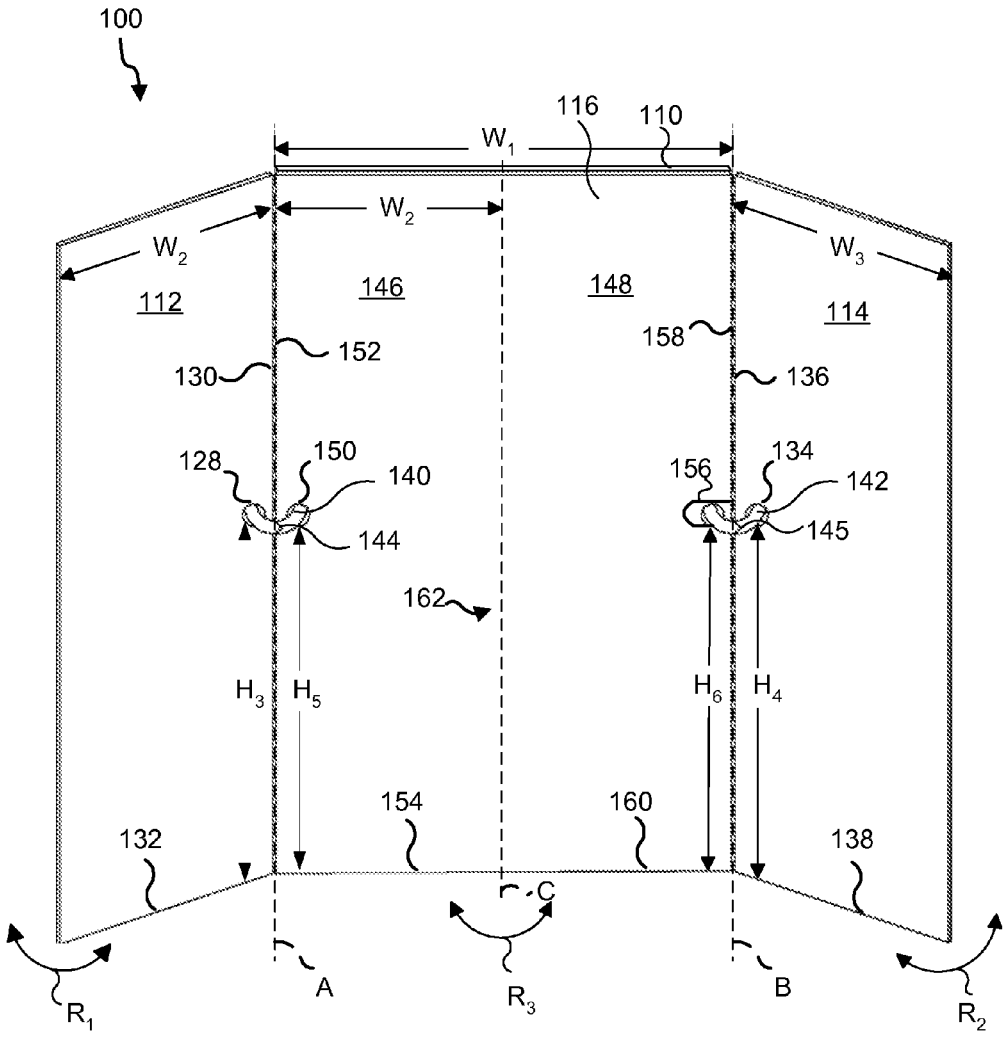
FIG. 1B is the expandable, hinged, multi-panel presentation apparatus of FIG. 1A, illustrating one position of the interior rectangular panel.

FIGS. 1A and 1B illustrate a front, perspective view of one embodiment of an apparatus 100 according to the present invention. The expandable, hinged, multi-panel presentation apparatus 100 comprises a main rectangular panel 110, a right side rectangular panel 112, a left side rectangular panel 114, and an interior rectangular panel 116 (See FIG. 1B). Each of these panels 110, 112, 114, 116 is made of a sturdy material, such that when the apparatus 100 is fully assembled, there is sufficient structural integrity to freely stand. For example, the panels 110, 112, 114, 116 may be made of poster board, cardboard, rigid plastic sheets, or other durable material. Additionally, each panel 110, 112, 114, 116 has a front display face for presenting material. The interior rectangular panel 116 also has a back display face for presenting material. The right side rectangular panel 112 and left side rectangular panel 114 may also include a back display face for presenting material. Those of ordinary skill in the art recognize that the size of each panel 110, 112, 114, 116 and the overall size of the apparatus 100 may vary to accommodate various user or event restrictions without greatly affecting the amount of presentation space available or the benefits of the present invention.

The main rectangular panel 110 supports the right and left side rectangular panels 112, 114 and typically presents the most important presentation material. As shown in FIG. 1A, the main rectangular panel 110 has a width $W_1$, a first hole 118 disposed in its right vertical edge 120 at a height $H_1$ from its bottom horizontal edge 122, and a second hole 124 disposed in the left vertical edge 126 at a height $H_2$ from its bottom horizontal edge 122. The main rectangular panel 110 may also include more holes disposed in its right and left vertical edges 120, 126.

The right side rectangular panel 112 presents material to the right of the main rectangular panel 110 and has a width $W_2$ that is preferably less than the width $W_1$ of the main rectangular panel 110. The right side rectangular panel 112 has a third hole 128 disposed in its left vertical edge 130 at a height $H_3$ from its bottom horizontal edge 132 such that $H_3$ is substantially the same as $H_1$. The right side rectangular panel 112 may also include more holes disposed in its left vertical edge 130.

The left side rectangular panel 114 presents material to the left of the main rectangular panel 110 and has a width $W_3$ that is less than the width $W_1$ of the main rectangular panel 110. In certain embodiments, $W_3$ may equal $W_2$. The left side rectangular panel 114 has a fourth hole 134 disposed in its right vertical edge 136 at a height $H_4$ from its bottom horizontal edge 138 such that $H_4$ is substantially the same as $H_2$. The left side rectangular panel 114 may also include more holes disposed in its right vertical edge 136.

A first fastener 140 and a second fastener 142 link the panels 110, 112, 114 together. The first and second fasteners 140, 142, in one embodiment, comprise a ring, such as one of a split ring, jump ring, clasp ring, and triangle ring. In another embodiment, the fasteners 140, 142 comprise a piece of flexible metal wire or plastic. In a further embodiment, the fasteners 140, 142 comprise a piece of material, such as one of a thread, ribbon, and string. In yet another embodiment, the fasteners 140, 142 comprise a corresponding pair of hook and loop strips such as Velcro® strips.

The first fastener 140 links the main rectangular panel 110 and right side rectangular panel 112 together. The first fastener 140 permits the right side rectangular panel 112 to pivot relative to the main rectangular panel 110 about axis A along arc $R_1$. The first fastener 140, in one embodiment, comprises a first mouth 144 that opens, extends through the first hole 118, extends through the third hole 128, and closes to removeably engage the main rectangular panel 110 and the right side rectangular panel 112.

Likewise, the second fastener 142 links the main rectangular panel 110 and the left side rectangular panel 114 together. The second fastener 142 permits the left side rectangular panel 114 to pivot along arc $R_2$ about axis B. The second fastener 142 comprises a second mouth 145 that opens, extends through the second hole 124, extends through the fourth hole 134, and closes to removeably engage the main rectangular panel 110 and the left side rectangular panel 114.

As shown in FIG. 1B, the interior rectangular panel 116 presents material in front of the main rectangular panel 110 in a first position. In one embodiment, the interior rectangular panel 116 has a width $W_1$ and includes a proximal interior section 146, a distal interior section 148, and a vertical hinge 162 which connects the distal interior section 148 to the proximal interior section 146. In the present embodiment, the interior rectangular panel 116 is linked to the main rectangular panel 110 and the right side rectangular panel 112 by the first fastener 140.

The proximal interior section 146 has a width $W_2$ and comprises a fifth hole 150 disposed in its right vertical edge 152 at a height $H_5$ from its bottom horizontal edge 154 such that $H_5$ is substantially the same as $H_3$. The mouth 144 of the first fastener 140 opens, extends through the fifth hole 150, and then closes to couple the interior rectangular panel 116 to the apparatus 100. The proximal interior section 146 may also include additional holes disposed in its fight vertical edge 152.

The distal interior section 148, in certain embodiments, has a notch 156 disposed in its left vertical edge 158 at a height $H_6$ from its bottom horizontal edge 160 such that $H_6$ is substantially the same as $H_4$. The notch 156 allows the second fastener 142 to operably engage the notch 156 such that the interior rectangular panel 116 lies flush with the main rectangular panel 110. The distal interior section 148 may also include additional notches disposed in its left vertical edge 158.

The vertical hinge 162, in one embodiment, comprises a living hinge. As used herein, "living hinge" means a hinge that includes no moving parts, such as thin section of the material that bends to allow movement. For example, in one embodiment, the material of the interior rectangular panel 116 may be folded to create the vertical hinge 162. Alternatively, the interior rectangular panel 116 may comprise multiple layers and the vertical hinge may be formed by a vertical cut in all the layers except one external layer. In another embodiment, the vertical hinge 162 comprises a planar adhesive. In a further embodiment, the vertical hinge 162 comprises a corresponding pair of hook and loop strips such as Velcro® strips. In yet another embodiment, the vertical hinge 162 is a mechanical hinge. The vertical hinge 162, in yet a further embodiment, comprises a bi-directional hinge. In another embodiment, the vertical hinge 162 comprises a mono-directional hinge.

In one embodiment the interior rectangular panel 116 comprises a proximal interior section 146 and a distal interior section 148 of a single piece of material such that the two interior sections 146, 148 are divided by the vertical hinge 162, wherein the vertical hinge 162 is a fold in the interior rectangular panel 116. In a further embodiment, the interior rectangular panel 116 comprises a proximal interior section 146 and a distal interior section 148 such that the two interior sections 146, 148 are separate panels that are linked by the vertical hinge 162.

Figure 2:
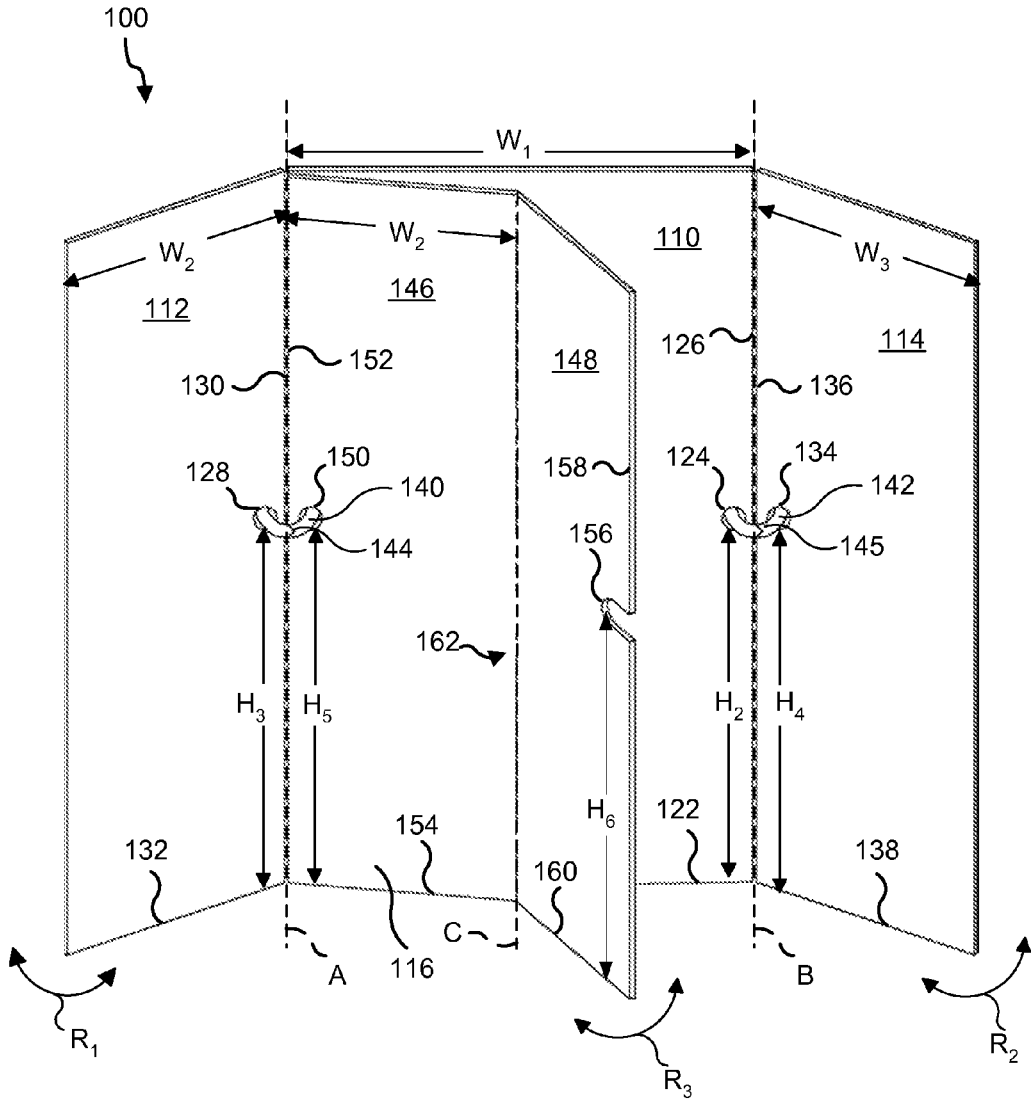
FIG. 2 is the expandable, hinged, multi-panel presentation apparatus of FIG. 1B illustrating the movement of the interior rectangular panel.

FIG. 2 illustrates the movement of the interior rectangular panel 116 relative to the apparatus 100 when the interior rectangular panel 116 presents material in front of the right side rectangular panel 112. The vertical hinge 162 allows the distal interior section 148 to pivot about axis C along arc $R_3$. The distal interior section 148 may overlay the proximal interior section 146 giving the interior rectangular panel 116 an effective width equal to the width $W_2$ of the right side rectangular panel 112. The fastener 140 permits the interior rectangular panel 116 to pivot about axis A along arc $R_1$. The interior rectangular panel 116 may overlay the right side rectangular panel 112 and present material on its back display face. In this present embodiment, material presented on the front display face of the main rectangular panel 110 is now displayed. Of course, the interior rectangular panel 116 first pivots about axis C to display presentation material on a back display face of the distal interior section 148. Next, the interior rectangular panel 116 pivots about axis A to display presentation material on a back display face of the proximal interior section 146. In addition, one interior rectangular panel 116 pivots about axis A to overlay right side rectangular panel 112 the distal interior section 148 may be pivoted about axis C to unfold and present back displays of both the distal interior section 148 and the proximal interior section 146.

While the embodiment described in detail above illustrates the attachment of the interior rectangular panel 116 to a right side of the main rectangular panel 110, it is apparent that in another embodiment, not shown, the interior rectangular panel 116 may attach to the main rectangular panel 110 on a left side of the main rectangular panel 110. In a further embodiment, a plurality of interior panels 116 are coupled to the apparatus 100 by one of the first fastener 140 and/or the second fastener 142. In yet a further embodiment, one or more interior rectangular panels 116 is coupled to the apparatus 100 by the first fastener 140 and one or more interior rectangular panels 116 is coupled to the apparatus 100 by the second fastener 142.

In another embodiment (not shown), the main rectangular panel 110 further comprises a support associated with its back surface such that the main rectangular panel 110 is stabilized in a substantially vertical orientation. The support may comprise legs integrated with the back surface of the main rectangular panel 110 that fold out to provide stability. Alternatively, the support may be a separate stabilizing entity engaged with the back surface of the main rectangular panel 110 to maintain vertical orientation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An expandable, hinged, multi-panel presentation system comprising:

a middle rigid rectangular presentation panel comprising a width, a right vertical edge having a first hole, and a left vertical edge having a second hole;

a right rigid side rectangular presentation panel having a width that is less than the width of the middle rigid rectangular presentation panel and having a left vertical edge having a third hole, the third hole aligned with the first hole of the middle rigid rectangular presentation panel;

a left rigid side rectangular presentation panel having a width that is equal to the width of the right rigid side rectangular presentation panel and having a right vertical edge having a fourth hole, the fourth hole aligned with the second hole of the middle rigid rectangular presentation panel;

a first free-standing hinged split ring fastener configured to extend through the first hole in the middle rigid rectangular presentation panel and the third hole in the right rigid side rectangular presentation panel, the first free-standing hinged split ring fastener comprising a mouth configured to open and close such that the first free-standing hinged split ring fastener removeably engages the middle rigid rectangular presentation panel and the right rigid side rectangular presentation panel;

a second free-standing hinged split ring fastener configured to extend through the second hole in the middle rigid rectangular presentation panel and the fourth hole in the left rigid side rectangular presentation panel, the second free-standing hinged split ring fastener comprising a mouth configured to open and close such that the second free-standing hinged split ring fastener removeably engages the middle rigid rectangular presentation panel and the left rigid side rectangular presentation panel; and a rigid interior rectangular presentation panel having the same width as the middle rigid rectangular presentation panel, the rigid interior rectangular presentation panel having a proximal rigid presentation sub-panel with a width equal to the width of the right rigid side rectangular presentation panel and having a vertical edge, a distal rigid presentation sub-panel with a vertical edge, a vertical bi-directional hinge operably coupling the distal rigid presentation sub-panel to the proximal rigid presentation sub-panel whereby the distal rigid presentation sub-panel pivots relative to the proximal rigid presentation sub-panel, the rigid interior rectangular presentation panel having a fifth hole disposed in the vertical edge of the proximal rigid presentation sub-panel a open ended unobstructed notch disposed in the vertical edge of the distal rigid presentation sub-panel, the fifth hole positioned such that one of the first free-standing hinged split ring fastener and the second free-standing hinged split ring fastener operably engages the fifth hole, and the open ended unobstructed notch positioned such that one of the first free-standing hinged split ring fastener and the second free-standing hinged split ring fastener operably engages the notch without retaining the vertical edge of the distal interior section.

2. The expandable, hinged, multi-panel presentation system of claim 1, wherein the interior rectangular panel has a front display face comprising first presentation material and a back display face comprising second presentation material.

3. The expandable, hinged, multi-panel presentation system of claim 2, wherein the vertical hinge is a member of the group consisting of a living hinge, a planar adhesive, a corresponding pair of hook and loop strips, and a mechanical hinge.

4. An expandable, hinged, multi-panel presentation system comprising:

a middle rigid rectangular presentation panel having a width, a right vertical edge having a first hole, and a left vertical edge having a second hole;

a right rigid side rectangular presentation panel having a width that is less than the width of the middle rigid rectangular presentation panel and having a left vertical edge having a third hole, the third hole aligned with the first hole of the middle rigid rectangular presentation panel;

a left rigid side rectangular presentation panel having a width that is equal to the width of the right rigid side rectangular presentation panel and having a right vertical edge having a fourth hole, the fourth hole aligned with the second hole of the middle rigid rectangular presentation panel;

a first free-standing hinged split ring fastener configured to extend through the first hole in the middle rigid rectangular presentation panel and the third hole in the right rigid side rectangular presentation panel, the first free-standing hinged split ring fastener comprising a mouth configured to open and close such that the first free-standing hinged split ring fastener removeably engages the middle rigid rectangular presentation panel and the right rigid side rectangular presentation panel;

a second free-standing hinged split ring fastener configured to extend through the second hole in the middle rigid rectangular presentation panel and the fourth hole in the left rigid side rectangular presentation panel, the second free-standing hinged split ring fastener comprising a mouth configured to open and close such that the second free-standing hinged split ring fastener removeably engages the middle rigid rectangular presentation panel and the left rigid side rectangular presentation panel; and a rigid interior rectangular presentation panel having the same width as the middle rigid rectangular presentation panel, the rigid interior rectangular presentation panel having a proximal rigid presentation sub-panel with a width equal to the width of the right rigid side rectangular presentation panel and having a vertical edge, a distal rigid presentation sub-panel with a width equal to the width of the right side rectangular presentation panel, the distal rigid presentation sub-panel having a vertical edge, a vertical bi-directional hinge that couples the distal rigid presentation sub-panel to the proximal rigid presentation sub-panel whereby the distal rigid presentation sub-panel pivots relative to the proximal rigid presentation sub-panel, the rigid interior rectangular presentation panel having a fifth hole disposed in the vertical edge of the proximal rigid presentation sub-panel and an open ended unobstructed notch disposed in the vertical edge of the distal rigid presentation sub-panel, the fifth hole positioned such that one of the first free-standing hinged split ring fastener and the second free-standing hinged split ring fastener operably engages the fifth hole, and the open-ended unobstructed notch positioned to receive one of the first free standing hinged split ring fastener and the second free-standing hinged split ring fastener within the notch without retaining the vertical edge of the distal rigid presentation sub-panel such that the rigid interior rectangular presentation panel can lay flat against the middle rectangular presentation panel when the rigid interior rectangular presentation panel is positioned adjacent to the middle rectangular presentation panel.

* * * * *